United States Patent [19]

Blotenberg

[11] 4,298,310

[45] Nov. 3, 1981

[54] PROCESS AND APPARATUS FOR PREVENTION OF SURGING IN TURBOCOMPRESSORS

[75] Inventor: Wilfried Blotenberg, Oberhausen, Fed. Rep. of Germany

[73] Assignee: Gutehoffnungshütte Sterkrade AG, Fed. Rep. of Germany

[21] Appl. No.: 52,823

[22] Filed: Jun. 27, 1979

[30] Foreign Application Priority Data

Jun. 27, 1978 [DE] Fed. Rep. of Germany ..... 2828124

[51] Int. Cl.[3] ..... F04D 27/02

[52] U.S. Cl. ..... 415/1; 415/15; 415/27

[58] Field of Search ..... 415/1, 27, 28, 15; 60/39.29

[56] References Cited

U.S. PATENT DOCUMENTS

| | | | |
|---|---|---|---|
| 3,737,252 | 6/1973 | Pilarczyk et al. | 415/27 |
| 3,809,490 | 5/1974 | Harner | 415/28 |
| 4,139,328 | 2/1979 | Kuper et al. | 415/1 |
| 4,164,035 | 8/1979 | Glemon et al. | 60/39.29 |

*Primary Examiner*—Louis J. Casaregola
*Attorney, Agent, or Firm*—McGlew and Tuttle

[57] ABSTRACT

A process and apparatus for operating a turbocompressor having an output at an actual value of flow and pressure and a blow-off valve for regulating the output to prevent surging of the output above a surge limit and to prevent a reduction of the output below a minimum value, with a comparing unit for measuring the actual value, and a controller unit for controlling the blow-off valve in accordance with the output of the comparing unit comprising, forming a first difference value between the theoretical value and the actual value, forming a delayed value from the difference value and thereafter forming a second difference value between the delayed value and the first difference value to control the blow-off valve. The apparatus for effecting the process comprises summing units for forming the various difference values, a delay unit for delaying the first difference value and, in one embodiment, a limiter unit for limiting the second difference value which is thereafter added to the theoretical value before the resulting value is applied to the controller unit for controlling the blow-off valve.

9 Claims, 3 Drawing Figures

PROCESS AND APPARATUS FOR PREVENTION OF SURGING IN TURBOCOMPRESSORS

FIELD AND BACKGROUND OF THE INVENTION

The present invention relates to a new and useful apparatus and process for the operation of turbocompressors in which the throughput or a signal derived from the throughput and the discharge pressure or the pressure ratio, are continuously monitored and compared with permissible values. Measures are taken, according to the invention, to prevent surging. Upon reaching a blow-off line of the compressor characteristic curve which runs parallel to the surge limit, one or a plurality of blow-off valves are opened, for example, so that the compressor throughput does not fall below a minimum value which depends on the pressure ratio.

Surge limit control for compressors have already been undertaken with the use of mechanical/hydraulic controls. Despite high instrument and engineering expenditures, however, it is not possible in known controls to exactly adjust the blow-off line in order to reliably prevent surging. A further disadvantage lies in the high maintenance expense and the considerable susceptibility of these mechanical hydraulic control devices to trouble.

It is also known that an electronic surge limit control may be used for compressors (see Mitteilung 542 der Wärmestelle des Vereins deutscher Eisenhütterleute, Report 542 of the Thermal Section of the German Ironworkers' Association). The surge limit control on compressors with guide vane adjustments is, in these units, designed similar to that of compressors with throttle adjustment, while, of course, there is the difference that because of the non-linear surge limit curve, a function generator is provided for the formation of the command variables of the surge limit control.

It has proven to be a disadvantage in these known control devices, that under certain operating conditions, that is, in the case of manual control intervention and with strong pressure fluctuations, surging of the compressor cannot readily be prevented.

U.S. Pat. No. 4,139,328 to Kuper et al (German Offenlegungsschrift 2,623,899), is incorporated here by reference. This patent teaches that an electronic surge limit controller may be used to control the blow-off valves, in which the control difference for the controller, which depends upon the actual pressure and throughput values, is amplified in a non-linear manner such that the amplification is increased when the control difference becomes negative, that is, when the operating point of the compressor moves into the impermissible range on the other side of the blowoff line of the compressor characteristic. Moreover, in this unit, an extreme value selector is imposed on the control, which selector takes into consideration the greatest control deviation, namely, the actual control deviation or the difference between control output and manual control command.

In this functional control device, it is, to be sure, a disadvantage that the rate of variation of the actual value cannot be taken into consideration or that allowance cannot be made for whether the deviation from actual value becomes greater or smaller. In practice, this means that, regardless of operating status, the blow-off line remains constantly in service.

SUMMARY OF THE INVENTION

It is an object of the present invention to obtain improved prevention of surging in turbocompressors, while the blow-off line or value level, for reasons of efficiency, lies as close as possible to the surge limit line and its position is displaceable corresponding to the variations of the actual value. The expenditure for the control device should be as low as possible, and it should be capable of being assembled largely from commercially available circuit elements.

This object is accomplished pursuant to the invention by a process and apparatus of the type mentioned above which is characterized in that outside the controller the difference is formed from the theoretical value and the actual value. This is supplied, once directly and secondly delayed by way of a delay member, to a subtracting station and finally added to the theoretical value. The signal may advantageously be supplied to a limiter and carried out further in such fashion that the control difference is formed from a theoretical value and an actual value outside the controller, supplied, once multiplied by the factor of 2 and secondly delayed by way of a delay member, to a subtracting station and then imposed on the controller.

A further object of the present invention is to provide an apparatus for effecting the process which is simple in design, rugged in construction and economical to manufacture.

For an understanding of the principles of the invention, reference is made to the following description of typical embodiments thereof as illustrated in the accompanying drawings.

DESCRIPTION OF THE PREFERRED EMBODIMENTS

Figure 1:
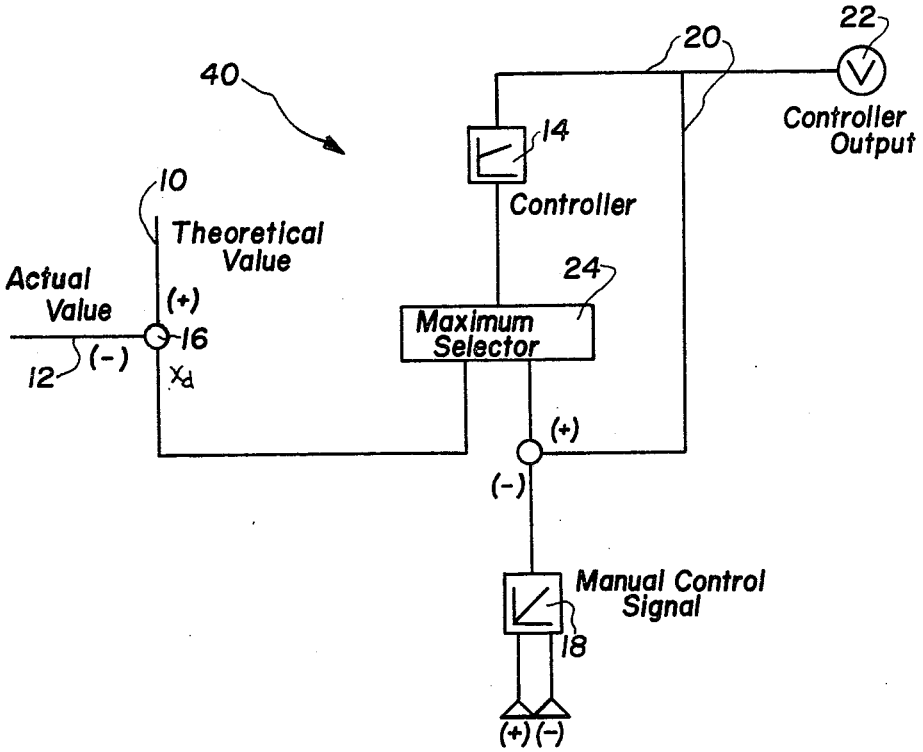
Fig. 1 (PRIOR ART)
FIG. 1 is a schematic circuit diagram of a conventional arrangement for a control system with the possibility of manual intervention.

Turning first to FIG. 1, in the known control device, generally designated 40, the difference between a theoretical value at 10 for a particular selected parameter of compressor operation which is generated by a function generator, and an actual value (control deviation) at 12 of the same parameter, is formed in a unit 16 outside the controller 14.

For manual adjustment of the blow-off valve 22 by the controller 14, a second fictitious "control deviation" is formed as a difference between a manual control signal from a manual control signal unit 18 and the control output at 20. These two signals are imposed on the controller 14 via a maximum selector 24.

The maximum selector 24, in each instance, selects the most positive control deviation and imposes it on the controller 14. The selected control deviation thus is the one which opens the valve 22 the most rapidly or closes it the most slowly. The valve 22 remains open until the most positive signal is zero. It is, by this means possible, therefore, to open the valve further by a positive control deviation than is prescribed by the theoretical value.

In contrast to this known system, the control device according to the invention, in FIGS. 2 and 3, has additional members for taking a time component into consideration, which operates as follows:

Upon a shift of the working point of a compressor which is controlled by a valve 23 connected to the inventive control system 50, toward the blow-off line in the compressor characteristic, the actual value at 13 decreases. The difference potential $x_d$ changes with a positive stop. This value is the output of difference unit 17. This magnitude signal $x_d$ is multiplied by a fixed magnitude in multiplier 27, preferably by 2, and supplied directly to a summing station 31. The signal $x_d$ is also delayed through a $PT_1$-member 33, and then also supplied to the summing station 31. The output of the summing station 31 thereby becomes more positive than the signal $x_d$. This is equivalent to a shift of the blow-off line toward the working point. The faster the working point moves toward the blow-off line, the greater the shift.

When the working point moves away from the blow-off line, the blow-off line shifts toward the surge limit. This is, in most cases, without influence on the function of the control system. Where this is not desirable, this effect may be prevented by a parallel imposition of magnitude signal $x_d$ (dotted circuit completion in FIG. 2) on the maximum selector 25 which is connected to the controller 15.

Figure 2:
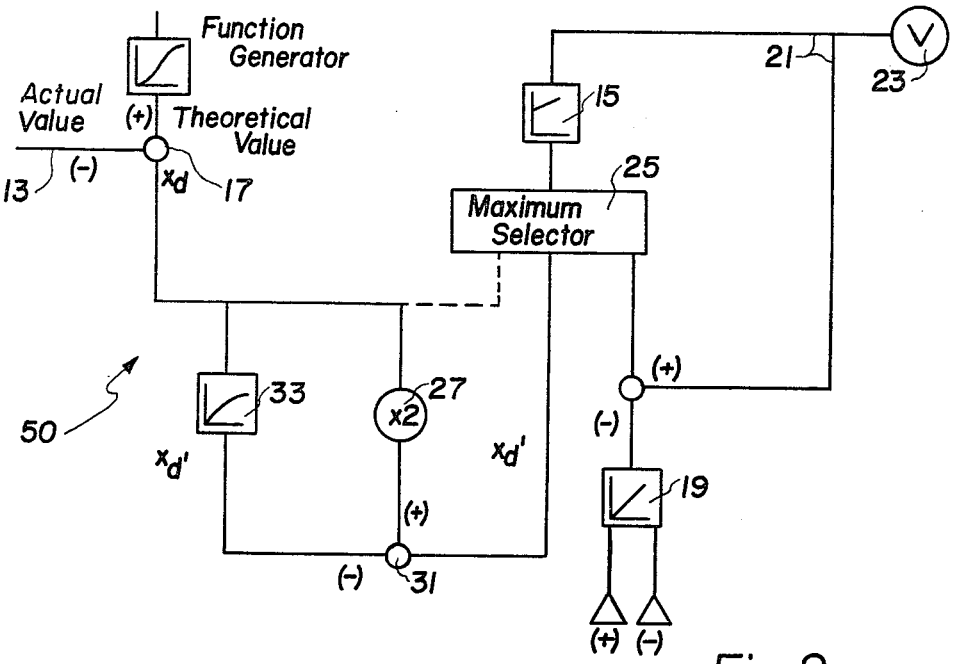
FIG. 2 is a control diagram pursuant to the invention; likewise with the possibility of manual intervention.
Figure 3:
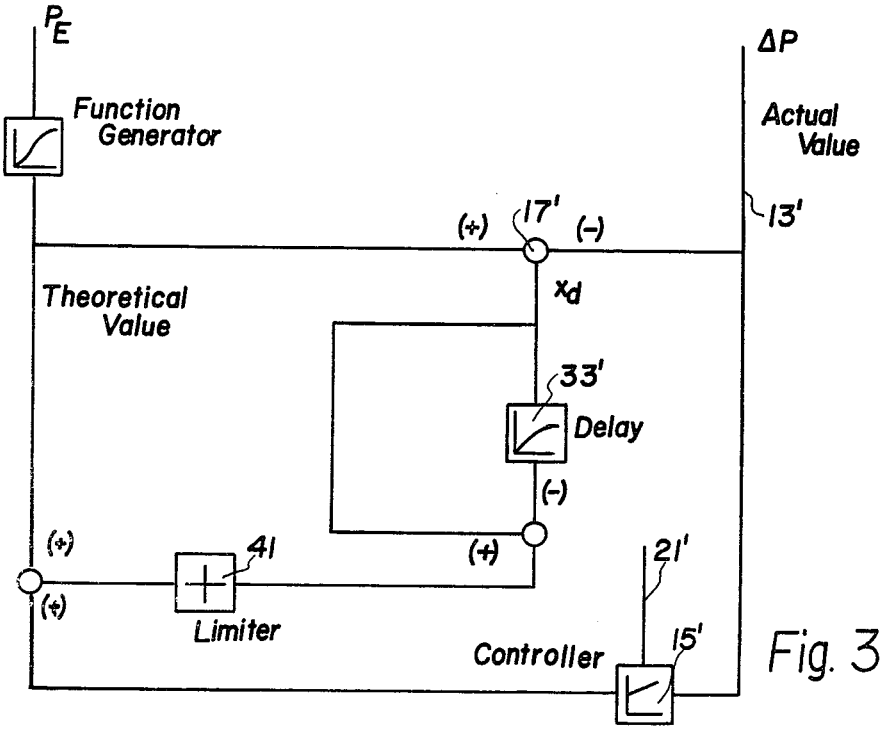
FIG. 3 is a control diagram pursuant to the invention, exclusively for automatic operation.

In FIG. 3, like elements, as those found in FIG. 2, are designated with like numbers with the addition of a prime.

In control systems in which the control deviation cannot be externally influenced, the system may be designed according to FIG. 3. The limiter 41 causes the expansion to be effective in only one direction.

As shown in FIG. 3, a function generator provides the theoretical value signal. A first summing unit 17' receives both the theoretical value signal and a signal representative of the actual value of the operating point and produces a difference signal which is fed directly to one input of a second summing unit and through a delay circuit to the other input of the second summing unit. The difference signal produced by the second summing unit is fed through the limiter 41 to one input of a third summing unit, the third summing unit, which also receives the theoretical value signal, produces a difference signal which is fed to one input of the controller 15', the other input of the controller receives the signal representative of the actual value of the operating point of the compressor (13'). The purpose of the limiter circuit 41 is to make any increase in deviation effective in only one sense.

As is evident, the invention has for the first time, made it possible for the rate of a variation in actual value to be taken into consideration and thereby to ensure reliable control, particularly in the case of strong disturbances, that is, even then reliably to prevent surging. Since only known commercially available electronic components are used and the control device is accordingly economically feasible and easily applied by those skilled in the art, the invention may be regarded as an ideal solution to the problems which arise.

According to FIG. 2, the comparing signal is amplified, for example, twice (X2). This amplification may, of course, alternatively be replaced by, for example, having the signal $x_d$ undergo a corresponding weakening in the parallel branch. Essential, in this connection, is only the proportion of the signal being added.

While specific embodiments of the invention have been shown and described in detail to illustrate the application of the principles of the invention, it will be understood that the invention may be embodied otherwise without departing from such principles.

What is claimed is:

1. A process for the operation of a turbo-compressor having an output at an actual value of an operating parameter, and a blow-off valve for regulating the output to prevent surging of the output above a surge limit and to prevent a reduction of the output below a minimum value, with comparing means for measuring the actual value and comparing to a permissible theoretical value for the parameter, and controlling means for controlling the blow-off valve in accordance with an output from the comparing means, comprising: forming a first difference value between the theoretical value and the actual value, forming a delayed value from the difference value, forming a second difference value between the delayed value and the first difference value, and controlling the blow-off valve in accordance with the second difference valve.

2. A process according to claim 1, further including multiplying the first difference value by a factor of 2 before the second difference value is formed.

3. A process according to claim 2, further including providing a manual control value, providing a maximum selector unit for receiving the manual control value and the second difference value and supplying the maximum of these two values to the controller means for controlling the blow-off valve.

4. A process according to claim 3, further including providing the first difference value to the maximum selector unit.

5. A process according to claim 1, further including a limiter for receiving the second difference value and producing a limited second difference value, and adding the limited second difference value to the theoretical value for producing a third value for controlling the blow-off valve.

6. A process for the operation of a turbo-compressor with a throughput, in which a signal derived from the throughput is continuously measured, while for the prevention of surging, before a surge limit is reached, on reaching a blow-off line, it is provided that the turbo-compressor throughput does not fall below a minimum value dependent upon the discharge ratio, characterized in that outside the controller the difference is formed between a theoretical value and an actual value of the throughput, the difference is supplied, once directly and secondly delayed by way of a delay member, to a subtracting station and then added to the theoretical value to form a control value for controlling the blow-off line.

7. A process according to claim 6, characterized in that the signal is supplied to a limiter before addition to the theoretical value.

8. A process according to claim 6, characterized in that the control difference is formed from a theoretical value and an actual value outside the controller, supplied, once multiplied by the factor of two and secondly delayed by way of the delay member, to a subtracting station and then imposed on a controller for controlling the blowoff value.

9. An apparatus for the operation of a turbo-compressor having an output at an actual value of an operating parameter, a blow-off line for regulating the output to prevent surging of the output above a surge value and to prevent a reduction of the output below a minimum value, with comparing means for measuring the actual value and comparing it with a permissible theoretical value for the parameter, and controller means for controlling the blow-off line in accordance with the output of the comparing means, comprising: first difference means for producing a first difference value from the difference between the theoretical value and the actual value, delay means connected to the first difference means for delaying the first difference value, second difference means connected to the delay means and to the first difference means for producing a second difference value, the second difference means connected to the controller means for controlling the blow-off line.

* * * * *